US008066938B2

(12) United States Patent
Pike, Jr.

(10) Patent No.: US 8,066,938 B2
(45) Date of Patent: Nov. 29, 2011

(54) NI-CR-CO ALLOY FOR ADVANCED GAS TURBINE ENGINES

(75) Inventor: Lee M. Pike, Jr., Kokomo, IN (US)

(73) Assignee: Haynes International, Inc., Kokomo, IN (US)

( * ) Notice: Subject to any disclaimer, the term of this patent is extended or adjusted under 35 U.S.C. 154(b) by 549 days.

(21) Appl. No.: 11/451,787

(22) Filed: Jun. 13, 2006

(65) Prior Publication Data

US 2006/0222557 A1 Oct. 5, 2006

Related U.S. Application Data

(63) Continuation-in-part of application No. 10/934,920, filed on Sep. 3, 2004, now abandoned.

(51) Int. Cl.
*C22C 19/05* (2006.01)

(52) U.S. Cl. ..... 420/448; 148/428

(58) Field of Classification Search ..... 148/428; 420/448

See application file for complete search history.

(56) References Cited

U.S. PATENT DOCUMENTS

| | | | |
|---|---|---|---|
| 2,048,167 | A | 7/1936 | Pilling et al. |
| 2,515,185 | A | 7/1950 | Bieber et al. |
| 2,570,193 | A | 10/1951 | Bieber et al. |
| 2,688,536 | A | 9/1954 | Callaway et al. |
| 2,712,498 | A | 7/1955 | Gresham et al. |
| 2,747,993 | A | 5/1956 | Johnson |
| 2,793,950 | A | 5/1957 | Servi et al. |
| 2,805,154 | A | 9/1957 | Moore |
| 2,809,110 | A | 10/1957 | Darmara |
| 2,945,758 | A | 7/1960 | Jahnke et al. |
| 3,047,381 | A | 7/1962 | Hanink et al. |
| 3,065,072 | A | 11/1962 | Gittus et al. |
| 3,094,414 | A | 6/1963 | Franklin et al. |
| 3,107,167 | A | 10/1963 | Abkowtiz et al. |
| 3,222,165 | A | 12/1965 | Bird et al. |
| 3,248,213 | A | 4/1966 | Smith et al. |
| 3,390,023 | A | 6/1968 | Shira |

(Continued)

FOREIGN PATENT DOCUMENTS

| | | |
|---|---|---|
| GB | 583162 | 12/1946 |

(Continued)

OTHER PUBLICATIONS

ASM International, Materials Park, Ohio, ASM Handbook Volume 2: Properties and Selection: Nonferrous Alloys and Special Purpose Materials Preparation and Characterization of Pure Metals, pp. 1093-1097, Oct. 1990.*

*Primary Examiner* — Jessee R. Roe

(74) *Attorney, Agent, or Firm* — Buchanan Ingersoll & Rooney PC

(57) ABSTRACT

A wrought age-hardenable nickel-chromium-cobalt based alloy suitable for use in high temperature gas turbine transition ducts possessing a combination of three specific key properties, namely resistance to strain age cracking, good thermal stability, and good creep-rupture strength contains in weight percent 17 to 22 chromium, 8 to 15 cobalt, 4.0 to 9.1 molybdenum, up to 7 tungsten, 1.39 to 1.65 aluminum, 1.50 to 2.30 titanium, up to 0.80 niobium, 0.01 to 0.2 carbon, up to 0.01 boron, up to 3 iron, up to 1.5 tantalum and less than 0.02 zirconium, with a balance of nickel and impurities. Certain alloying elements must be present in amounts according to two equations here disclosed.

33 Claims, 3 Drawing Sheets

U.S. PATENT DOCUMENTS

| | | | | |
|---|---|---|---|---|
| 3,479,157 | A | 11/1969 | Richards et al. | |
| 3,516,826 | A | 6/1970 | Ward et al. | |
| 3,723,107 | A | 3/1973 | Richards et al. | |
| 3,723,108 | A | 3/1973 | Twigg et al. | |
| 3,871,928 | A | 3/1975 | Smith, Jr. et al. | |
| 4,039,330 | A | 8/1977 | Shaw | |
| 4,810,467 | A | 3/1989 | Wood et al. | |
| 5,131,961 | A | 7/1992 | Sato et al. | |
| 5,370,497 | A | 12/1994 | Doi et al. | |
| 5,858,558 | A | 1/1999 | Zhao et al. | |
| 6,258,317 | B1 | 7/2001 | Smith et al. | |
| 6,478,897 | B1 * | 11/2002 | Izumida et al. | 148/428 |

FOREIGN PATENT DOCUMENTS

| | | | |
|---|---|---|---|
| GB | 583841 | | 1/1947 |
| GB | 607616 | | 9/1948 |
| GB | 626204 | | 7/1949 |
| GB | 1029609 | | 5/1966 |
| JP | 01-129942 | | 5/1989 |
| JP | 06-172900 | | 6/1994 |
| JP | 2003-113434 | * | 4/2003 |
| KR | 10-1994-0013942 | | 1/1996 |
| WO | 9723659 | | 7/1997 |

* cited by examiner

NI-CR-CO ALLOY FOR ADVANCED GAS TURBINE ENGINES

CROSS REFERENCE TO RELATED APPLICATION

This is a continuation-in-part of U.S. patent application Ser. No. 10/934,920, filed Sep. 3, 2004 now abandoned.

FIELD OF THE INVENTION

This invention relates to wroughtable high strength alloys for use at elevated temperatures. In particular, it is related to alloys which possess sufficient creep strength, thermal stability, and resistance to strain age cracking to allow for fabrication and service in gas turbine transition ducts and other gas turbine components.

BACKGROUND OF THE INVENTION

To meet the demand for increased operating efficiency, gas turbine engine designers would like to employ higher and higher operating temperatures. However, the ability to increase operating temperatures is often limited by material properties. One application with such a limitation is gas turbine transition ducts. Transition ducts are often welded components made of sheet or thin plate material and thus need to be weldable as well as wroughtable. Often gamma-prime strengthened alloys are used in transition ducts due to their high-strength at elevated temperatures. However, current commercially available wrought gamma-prime strengthened alloys either do not have the strength or stability to be used at the very high temperatures demanded by advanced gas turbine design concepts, or can present difficulties during fabrication. In particular, one such fabrication difficulty is the susceptibility of many wrought gamma-prime strengthened alloys to strain age cracking. The problem of strain age cracking will be described in more detail later in this document. Another potential fabrication difficulty is hot cracking, a problem which may occur during welding, particularly in alloys which contain a certain amount of zirconium.

Wrought gamma-prime strengthened alloys are often based on the nickel-chromium-cobalt system, although other base systems are also used. These alloys will typically have aluminum and titanium additions which are responsible for the formation of the gamma-prime phase, $Ni_3(Al,Ti)$. Other gamma-prime forming elements, such as niobium and/or tantalum, can also be employed. An age-hardening heat treatment is used to develop the gamma-prime phase into the alloy microstructure. This heat treatment is normally given to the alloy when it is in the annealed condition. The presence of gamma-prime phase leads to a considerable strengthening of the alloy over a broad temperature range. Other elemental additions may include molybdenum or tungsten for solid solution strengthening, carbon for carbide formation, and boron for improved high temperature ductility.

Strain age cracking is a problem which limits the weldability of many gamma-prime strengthened alloys. This phenomenon typically occurs when a welded part is subjected to a high temperature for the first time after the welding operation. Often this is during the post-weld annealing treatment given to most welded gamma-prime alloy fabrications. The cracking occurs as a result of the formation of the gamma-prime phase during the heat up to the annealing temperature. The formation of the strengthening gamma-prime phase in conjunction with the low ductility many of these alloys possess at intermediate temperatures, as well as the mechanical restraint typically imposed by the welding operation will often lead to cracking. The problem of strain age cracking can limit alloys to be used up to only a certain thickness since greater material thickness leads to greater mechanical restraint.

Several types of tests to evaluate the susceptibility of an alloy to strain age cracking have been developed. These include the circular patch test, the restrained plate test, and various dynamic thermal-mechanical tests. One test which can be used to evaluate the susceptibility of an alloy to strain age cracking is the controlled heating rate tensile (CHRT) test developed in the 1960's. Recent testing at Haynes International has found the CHRT test to successfully rank the susceptibility of several commercial alloys in an order consistent with field experience. In the CHRT test, a sheet tensile sample is heated from a low temperature up to the test temperature at a constant rate (a rate of 25° F. to 30° F. per minute was used in the tests run at Haynes International). Once reaching the test temperature the sample is pulled to fracture at a constant engineering strain rate. The test sample starts in the annealed (not age-hardened) condition, so that the gamma-prime phase is precipitating during the heat-up stage as would be the case in a welded component being subjected to a post-weld heat treatment. The percent elongation to fracture in the test sample is taken as a measure of susceptibility to strain age cracking (lower elongation values suggesting greater susceptibility to strain age cracking). The elongation in the CHRT is a function of test temperature and normally will exhibit a minimum at a particular temperature. The temperature at which this occurs is around 1500° F. for many wrought gamma-prime strengthened alloys.

Good strength and thermal stability at the high temperatures demanded by advanced gas turbine concepts are two properties lacking in many current commercially available wrought gamma-prime strengthened alloys. High temperature strength has long been evaluated with the use of creep-rupture tests, where samples are isothermally subjected to a constant load until the sample fractures. The time to fracture, or rupture life, is then used as a measure of the alloy strength at that temperature. Thermal stability is a measure of whether the alloy microstructure remains relatively unaffected during a thermal exposure. Many high-temperature alloys can form brittle intermetallic or carbide phases during thermal exposure. The presence of these phases can dramatically reduce the room-temperature ductility of the material. This loss of ductility can be effectively measured using a standard tensile test.

Many wrought gamma-prime strengthened alloys are available in sheet form today in today's marketplace. The Rene-41 or R-41 alloy (U.S. Pat. No. 2,945,758) was developed by General Electric in the 1950's for use in turbine engines. It has excellent creep strength, but is limited by poor thermal stability and resistance to strain age cracking. A similar General Electric alloy, M-252 alloy (U.S. Pat. No. 2,747,993), was also developed in the 1950's. Although currently available only in bar form, the composition would easily lend itself to sheet manufacture. The M-252 alloy has good creep strength and resistance to strain age cracking, but like R-41 alloy is limited by poor thermal stability. The Pratt & Whitney developed alloy known commercially as WASPALOY alloy (apparently having no U.S. patent coverage) is another gamma-prime strengthened alloy intended for use in turbine engines and available in sheet form. However, this alloy has marginal creep strength above 1500° F., marginal thermal stability, and has fairly poor resistance to strain age cracking. The alloy commercially known as 263 alloy (U.S. Pat. No. 3,222,165) was developed in the late 1950's and introduced in 1960 by Rolls-Royce Limited. This alloy has excellent thermal stability and resistance to strain age cracking, but has very poor creep strength at temperatures greater than 1500° F. The PK-33 alloy (U.S. Pat. No. 3,248,213) was developed by the International Nickel Company and introduced in 1961. This alloy has good thermal stability and creep strength, but is limited by a poor resistance to strain age cracking. As suggested by these examples, no currently commercially available alloys possess the unique combination of three key properties: good creep strength and good thermal stability in the 1600° F. to 1700° F. temperature range, as well as good resistance to strain age cracking.

British Patent Publication GB 1 029 609 discloses an alloy adapted for use in the manufacture of gas turbine engines. However, the claimed compositional range of the British patent includes compositions which would be expected to fail at least one of the three gas turbine transition key properties described above based on the relationships taught by the present invention. Furthermore, the publication does not teach how to control the composition to meet these desired properties. Finally, no example alloys from that publication fall within the preferred ranges of the present invention.

Japanese Published Patent Application JP 01129942 discloses a nickel-based alloy said to have excellent hot workability. This publication teaches that zirconium improves the hot workability of the alloy and should be present in an amount of from 0.02% to 0.1%. But, such levels of zirconium are likely to produce hot cracking problems during welding of the alloy. This patent application also teaches that W is necessary for high temperature toughness, while I have found that W is not necessary for the key desired properties in a gas turbine transition duct, but may be present as a partial substitute for Mo according to a specified relationship. Moreover, the claimed compositional range of JP01129942 contains alloys which would be expected to fail one or more of the key properties for gas turbine transition ducts based on the relationships taught by the present invention. Finally, no example alloys from that publication fall within the preferred ranges of the present invention.

Japanese Published Patent Application JP 06172900 discloses a nickel-chromium-cobalt-molybdenum alloy containing from 8% to 12% molybdenum. However, this patent (issued in the 1990's) appears to claim compositions of much earlier patented alloys such as R-41 and M-252 alloys (described previously in this publication). The reference fails to recognize that molybdenum levels above 9.1% can lead to lower thermal stability and lower creep strength in this type of alloy. The claimed compositional range of this Japanese reference includes compositions which I have shown do not meet at least one of the key properties described above. Furthermore, the publication does not teach how to control the composition to meet these desired properties. Finally, no example alloys from that publication fall within the preferred ranges of the present invention.

Consequently, there is a need for an alloy which has a combination of good creep strength, good stability in the 1600° F. to 1700° F. temperature range, good resistance to strain age cracking and which can be welded without encountering hot cracking problems.

SUMMARY OF THE INVENTION

The principal objective of this invention is to provide new wrought age-hardenable nickel-chromium-cobalt based alloys which are suitable for use in high temperature gas turbine transition ducts and other gas turbine components possessing a combination of three specific key properties, namely resistance to strain age cracking, good thermal stability, and good creep-rupture strength.

It has been found that this objective can be reached with an alloy containing a certain range of chromium and cobalt, a certain range of molybdenum and possibly tungsten, and a certain range of aluminum, titanium and possibly niobium, with a balance of nickel and various minor elements and impurities. In addition, the zirconium content should be very low.

Specifically, the preferred ranges are 17 to 22 wt. % chromium, 8 to 15 wt. % cobalt, 4.0 to 9.1 wt. % molybdenum, up to 7.0 wt. % tungsten, 1.39 to 1.65 wt. % aluminum, 1.50 to 2.30 wt. % titanium, up to 0.80 wt. % niobium, up to 3 wt. % iron, 0.01 to 0.2 wt. % carbon, up to 0.015 wt. % boron, up to 1.5 wt. % tantalum and less than 0.02 wt. % zirconium, with a balance of nickel and impurities.

DESCRIPTION OF THE PREFERRED EMBODIMENT

Figure 1:
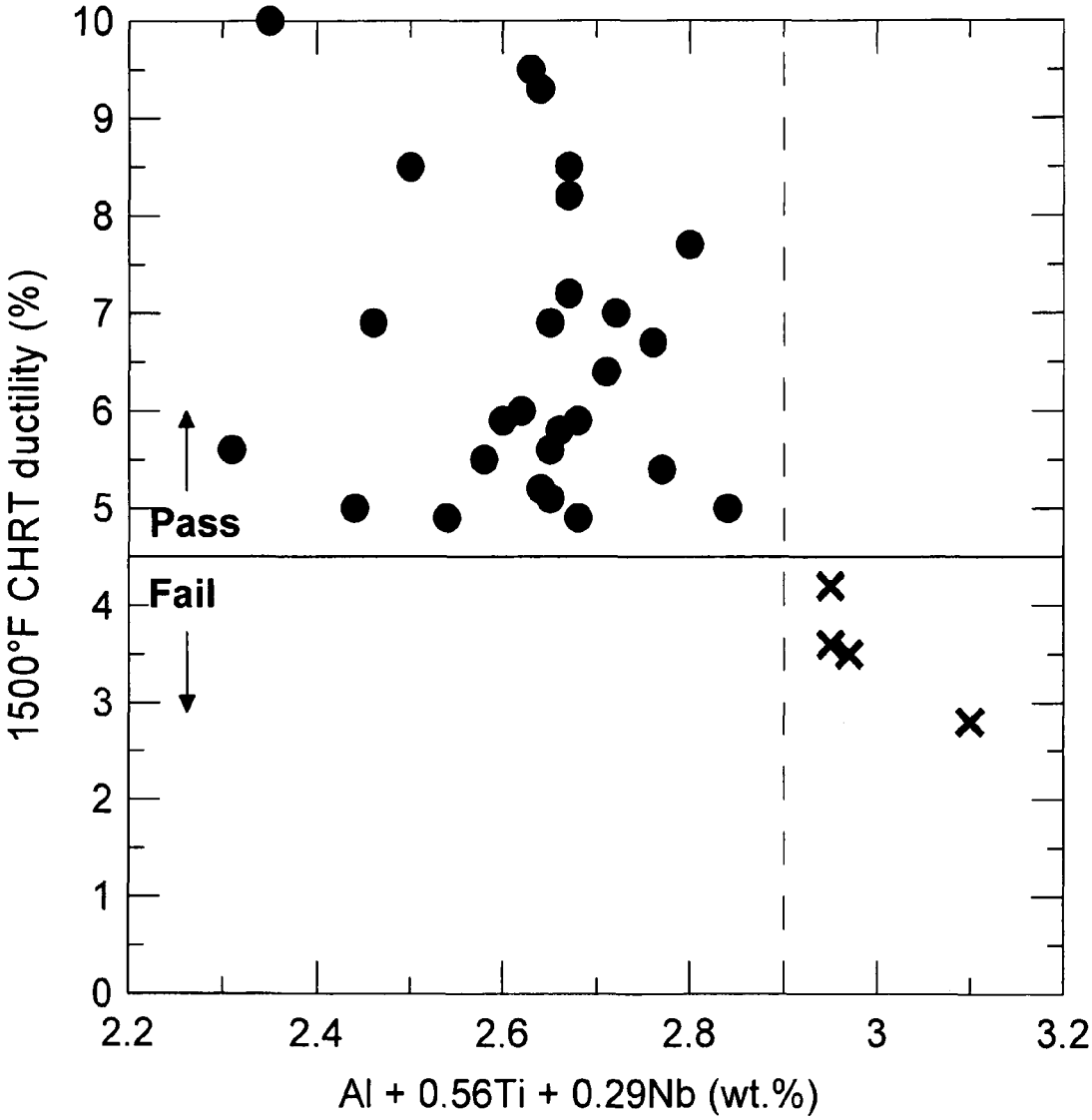
FIG. 1 is a graph of the ductility of several wrought age-hardenable nickel-chromium-cobalt based alloys in a controlled heating rate tensile test at 1500° F.

The wrought age-hardenable nickel-chromium-cobalt based alloys described here have sufficient creep strength, thermal stability, and resistance to strain age cracking to allow for service in sheet or plate form in gas turbine transition ducts as well as in other product forms and other demanding gas turbine applications. This combination of critical properties is achieved through control of several critical elements each with certain functions. The presence of gamma-prime forming elements such as aluminum, titanium, and niobium contribute significantly to the high creep-rupture strength through the formation of the gamma-prime phase during the age-hardening process. However, the combined amount of aluminum, titanium, and niobium must be carefully controlled to allow for good resistance to strain age cracking. Furthermore, the ration of titanium to aluminum must be controlled to favor formation of gamma prime over eta phase because eta phase causes embrittlement. Molybdenum and possibly tungsten are added to provide additional creep-rupture strength through solid solution strengthening. Again, however, the total combined molybdenum and tungsten concentration must be carefully controlled, in this case to ensure sufficient thermal stability of the alloy.

Based on the projected requirements for the next generation of gas turbine transition ducts, gamma-prime strengthened alloys have significant potential. Three of the more critical properties are creep strength, weldability (i.e. strain age cracking resistance), and thermal stability. However, producing a gamma-prime strengthened alloy which excels in all three of these properties is not straightforward and no commercially available alloy was found which possessed all three properties to a sufficient degree.

I tested 27 experimental and 5 commercial alloys whose compositions are set forth in Table 1. The experimental alloys have been labeled A through Z and 1. The commercial alloys were HAYNES R-41 alloy, HAYNES WASPALOY alloy, HAYNES 263 alloy, M-252 alloy, and NIMONIC PK-33 alloy. The alloys (including both the experimental and the commercial alloys) had a Cr content which ranged from 17.5 to 21.3 wt. %, as well as a cobalt content ranging from 8.3 to 19.6 wt. %. The aluminum content ranged from 0.49 to 1.89 wt. %, the titanium content from 1.53 to 3.12 wt. %, and the niobium content ranged from nil to 0.79 wt. %. The molybdenum content ranged from 3.2 to 10.5 wt. % and the tungsten ranged from nil up to 8.3 wt. %. Intentional minor element additions carbon and boron ranged from 0.034 to 0.163 wt. % and from nil to 0.008 wt. %, respectively. Iron ranged from nil to 3.6 wt. %.

All testing of the alloys was performed on sheet material of 0.047" to 0.065" thickness. The experimental alloys were vacuum induction melted, and then electro-slag remelted, at a heat size of 50 lb. The ingots so produced were soaked at 2150° F. and then forged and rolled with starting temperatures of 2150° F. The sheet thickness after hot rolling was 0.085". The sheets were annealed at 2150° F. for 15 minutes and water quenched. The sheets were then cold rolled to 0.060" thickness. The cold rolled sheets were annealed at temperatures between 2050 and 2175° F. as necessary to produce a fully recrystalized, equiaxed grain structure with an ASTM grain size between 4 and 5. Finally, the sheet material was given an age-hardening heat treatment of 1475° F. for 8 hours to produce the gamma-prime phase. The commercial alloys HAYNES R-41 alloy, HAYNES WASPALOY alloy, HAYNES 263 alloy, and NIMONIC PK-33 alloy were obtained in sheet form in the mill annealed condition. Since no commercially available M-252 alloy sheet could be found, a 50 lb. heat was produced for evaluation using the same method as described above for the experimental alloys. All five of the commercial alloys were given post-anneal age-hardening heat treatments according to accepted standards. These heat treatments are reported in Table 2.

To evaluate the three properties identified above as important (strain age cracking resistance, thermal stability, and creep strength) three different tests were employed on each of the alloys. The first test was the controlled heating rate tensile test (CHRT). The results of the CHRT testing are given in Table 3. The critical property in this test is the tensile ductility, as measured by a measurement of the elongation to failure. Alloys with a greater ductility in this test are expected to have greater resistance to strain age cracking. The objective of the present study was to have a ductility of 4.5% or greater. Of the experimental alloys, only alloy W failed to meet this requirement. For the commercial alloys, M-252 alloy and 263 alloy met the requirement, while PK-33 alloy, WASPALOY alloy, and R-41 alloy did not. It was found that the performance of a given alloy in the CHRT test could be correlated to the amount of the gamma-prime forming elements in the alloy using the following equation (where the elemental compositions are in wt. %):

$$Al+0.56Ti+0.29Nb<2.9 \quad (1)$$

The values of the left hand side of Eq. (1) for all of the alloys in this study are given in Table 1. All of the alloys which passed the CHRT test were found to obey Eq. (1). Furthermore, all of the alloys which did not obey Eq. (1) did not pass the CHRT test requirement, that is, they were found to have a 1500° F. CHRT ductility less than 4.5%. This relationship is shown more clearly in FIG. 1, where the 1500° F. CHRT ductility is plotted against the value of the left hand side of Eq. (1) for all of the alloys in the study. All testing was performed on samples in the annealed condition. The tensile ductility (measured as the percent elongation to failure) is plotted as a function of the compositional variable Al+0.56Ti+0.29Nb (where the elemental compositions are in wt. %). A line is drawn on the figure corresponding to a tensile ductility of 4.5%. All alloys plotted above this line (symbol: filled circles) were considered to have passed the controlled heating rate tensile test, while alloys plotted below the line (symbol: x-marks) were considered to have failed. A dashed vertical line is drawn at a value of 2.9 wt. % for the compositional variable, Al+0.56Ti+0.29Nb. All alloys with a value greater than 2.9 were found to fail the controlled heating rate tensile test.

TABLE 1

| Alloy | Ni | Cr | Co | W | Mo | Ti | Al | Nb | Zr | C | B | Fe | Mo + 0.52W | Al + 0.56Ti + 0.29Nb |
|---|---|---|---|---|---|---|---|---|---|---|---|---|---|---|
| 1 | BAL | 19.6 | 10.0 | <0.1 | 8.6 | 2.04 | 1.65 | 0.01 | <0.01 | 0.065 | 0.006 | 0.7 | 8.6 | 2.80 |
| A | BAL | 19.1 | 10.7 | 7.0 | 5.5 | 1.91 | 1.53 | <0.05 | 0.01 | 0.079 | 0.003 | <0.1 | 9.1 | 2.60 |
| B | BAL | 19.5 | 10.9 | 5.4 | 4.3 | 2.07 | 1.51 | 0.02 | 0.023 | 0.097 | 0.006 | <0.1 | 7.1 | 2.68 |
| C | BAL | 19.2 | 10.8 | 6.3 | 5.1 | 2.20 | 1.60 | <0.05 | 0.026 | 0.095 | 0.006 | <0.1 | 8.4 | 2.84 |
| D | BAL | 19.0 | 10.7 | 5.9 | 6.3 | 1.71 | 1.57 | 0.63 | 0.025 | 0.090 | 0.005 | <0.1 | 9.3 | 2.71 |
| E | BAL | 19.2 | 10.7 | 6.8 | 5.3 | 1.59 | 1.51 | 0.79 | 0.018 | 0.085 | 0.003 | <0.1 | 8.8 | 2.63 |
| F | BAL | 19.3 | 10.8 | 6.1 | 4.8 | 2.08 | 1.51 | <0.05 | 0.01 | 0.091 | 0.002 | <0.1 | 8.0 | 2.68 |
| G | BAL | 19.1 | 10.7 | 6.3 | 5.1 | 2.03 | 1.40 | <0.05 | 0.01 | 0.097 | 0.002 | <0.1 | 8.4 | 2.54 |
| H | BAL | 19.3 | 10.8 | 6.1 | 4.6 | 1.85 | 1.63 | <0.05 | <0.01 | 0.088 | 0.003 | 0.2 | 7.8 | 2.67 |
| I | BAL | 19.3 | 10.7 | 6.1 | 4.7 | 1.89 | 1.29 | <0.05 | <0.01 | 0.075 | 0.004 | 0.2 | 7.9 | 2.35 |
| J | BAL | 19.2 | 10.7 | 6.1 | 4.6 | 2.28 | 1.30 | <0.05 | <0.01 | 0.074 | 0.003 | 0.2 | 7.8 | 2.58 |
| K | BAL | 20.3 | 10.8 | <0.1 | 7.8 | 2.06 | 1.51 | <0.05 | <0.01 | 0.065 | 0.006 | 0.2 | 7.8 | 2.67 |
| L | BAL | 19.2 | 10.8 | 6.0 | 4.8 | 2.08 | 1.48 | 0.02 | <0.01 | 0.088 | 0.005 | <0.1 | 7.9 | 2.65 |
| M | BAL | 19.3 | 10.7 | 6.1 | 4.6 | 1.97 | 1.39 | <0.05 | <0.01 | 0.081 | 0.003 | 2.6 | 7.8 | 2.50 |
| N | BAL | 21.3 | 8.3 | 6.0 | 4.7 | 2.13 | 1.45 | <0.05 | <0.01 | 0.073 | 0.004 | 0.2 | 7.8 | 2.65 |
| O | BAL | 17.5 | 14.2 | 6.1 | 4.7 | 2.11 | 1.47 | <0.05 | <0.01 | 0.077 | 0.004 | 0.2 | 7.9 | 2.66 |
| P | BAL | 19.4 | 10.7 | 6.2 | 4.6 | 1.98 | 1.52 | <0.05 | <0.01 | 0.034 | 0.006 | 0.2 | 7.8 | 2.64 |
| Q | BAL | 19.2 | 10.7 | 2.7 | 6.2 | 2.01 | 1.54 | <0.05 | <0.01 | 0.056 | 0.006 | 0.2 | 7.6 | 2.68 |
| R | BAL | 19.9 | 10.1 | <0.1 | 7.2 | 2.05 | 1.50 | <0.05 | <0.01 | 0.058 | 0.006 | 0.7 | 7.2 | 2.65 |
| S | BAL | 20.2 | 9.6 | <0.1 | 8.3 | 2.12 | 1.48 | <0.05 | <0.01 | 0.062 | 0.007 | 0.7 | 8.3 | 2.67 |
| T | BAL | 18.9 | 10.1 | <0.1 | 9.3 | 2.07 | 1.56 | <0.05 | <0.01 | 0.066 | 0.006 | 0.7 | 9.3 | 2.72 |
| U | BAL | 18.7 | 10.5 | 8.3 | 6.3 | 1.80 | 1.43 | <0.05 | 0.01 | 0.089 | 0.002 | 0.1 | 10.6 | 2.44 |
| V | BAL | 19.6 | 10.9 | 0.1 | 9.9 | 2.21 | 1.33 | 0.65 | 0.02 | 0.094 | 0.004 | <0.1 | 9.9 | 2.76 |
| W | BAL | 19.4 | 10.9 | 5.4 | 4.3 | 2.30 | 1.66 | <0.05 | 0.024 | 0.096 | 0.006 | <0.1 | 7.1 | 2.95 |
| X | BAL | 18.8 | 10.3 | 7.6 | 6.0 | 1.53 | 1.39 | 0.72 | 0.01 | 0.089 | <0.002 | <0.1 | 9.9 | 2.46 |
| Y | BAL | 19.2 | 10.6 | 4.1 | 3.2 | 2.13 | 1.45 | <0.05 | <0.01 | 0.080 | 0.004 | 0.2 | 5.3 | 2.65 |
| Z | BAL | 19.2 | 10.8 | 0.1 | 10.5 | 2.10 | 1.46 | <0.05 | <0.01 | 0.077 | 0.004 | 0.2 | 10.5 | 2.64 |
| M-252 | BAL | 18.9 | 9.7 | <0.1 | 10.0 | 2.30 | 1.01 | 0.04 | <0.01 | 0.163 | 0.005 | 0.2 | 10.0 | 2.31 |

TABLE 1-continued

| Alloy | Ni | Cr | Co | W | Mo | Ti | Al | Nb | Zr | C | B | Fe | Mo + 0.52W | Al + 0.56Ti + 0.29Nb |
|---|---|---|---|---|---|---|---|---|---|---|---|---|---|---|
| PK-33 | BAL | 18.8 | 13.1 | — | 7.2 | 1.90 | 1.89 | — | 0.014 | 0.048 | 0.003 | 0.7 | 7.2 | 2.95 |
| 263 | BAL | 20.5 | 19.6 | <0.1 | 5.9 | 2.16 | 0.49 | <0.05 | 0.01 | 0.060 | 0.002 | 0.4 | 5.9 | 1.61 |
| WASP | BAL | 19.1 | 13.3 | <0.1 | 4.3 | 2.92 | 1.45 | 0.05 | 0.04 | 0.080 | 0.008 | 1.0 | 4.3 | 2.97 |
| R-41 | BAL | 19.1 | 10.9 | <0.1 | 9.7 | 3.12 | 1.48 | <0.05 | 0.01 | 0.090 | 0.008 | 3.6 | 9.7 | 3.10 |

TABLE 2

| Alloy | Heat Treatments* |
|---|---|
| Experimental alloys A-Z and 1 | 1475° F./8 hr./AC |
| R-41 alloy | 2050° F./30 min./AC + 1650° F./4 hr./AC |
| WASPALOY alloy | 1825° F./2 hr./AC + 1550° F./4 hr./AC + 1400° F./16 hr./AC |
| 263 alloy | 1472° F./8 hr./AC |
| M-252 alloy | 1400° F./15 hr./AC |
| PK-33 alloy | 1562° F./4 hr./AC |

*All heat treatments performed after an annealing heat treatment.

AC = air cool

TABLE 3

| Alloy | 1500° F. CHRT Ductility (% Elong.) |
|---|---|
| 1 | 7.7 |
| A | 5.9 |
| B | 4.9 |
| C | 5.0 |
| D | 6.4 |
| E | 9.5 |
| F | 6.0 |
| G | 4.9 |
| H | 8.5 |
| I | 10.0 |
| J | 5.5 |
| K | 5.4 |
| L | 5.7 |
| M | 8.5 |
| N | 5.6 |
| O | 5.8 |
| P | 5.2 |
| Q | 5.9 |
| R | 6.9 |
| S | 8.2 |
| T | 7.0 |
| U | 5.0 |
| V | 6.7 |
| W | 4.2 |
| X | 6.9 |
| Y | 5.1 |
| Z | 9.3 |
| R-41 alloy | 2.8 |
| WASPALOY alloy | 3.5 |
| 263 alloy | 22.9 |
| M-252 alloy | 5.6 |
| PK-33 alloy | 3.6 |

To evaluate the thermal stability of the alloys, their room temperature tensile ductility was determined after a long term thermal exposure. After performing the age-hardening heat treatments given in Table 2, samples from all of the experimental and commercial alloys were given a thermal exposure of 1600° F./1000 hrs./AC. A room temperature tensile test was performed on the thermally exposed samples and the results are given in Table 4. Ductility greater than 20% was considered acceptable. Using this guideline, the experimental alloys U, V, X, and Z were found to fail along with the commercial alloys M-252 alloy, WASPALOY alloy, and R-41 alloy. It was found that control of the elements molybdenum and tungsten was critical to develop a thermally stable alloy. The following relationship was found (where the elemental compositions are in wt. %):

$$Mo+0.52W<9.5 \quad (2)$$

The values of the left hand side of Eq. (2) for all of the alloys in this study are given in Table 1. All of the alloys which did not obey Eq. (2) were found to not have sufficient thermal stability, that is, their room temperature tensile ductility after a 1000 hour thermal exposure at 1600° F. was found to be less than 20%. One alloy (WASPALOY alloy) was found to satisfy Eq. (2), but to have poor thermal stability. However, this alloy did not satisfy Eq. (1) and therefore is not suitable for the target application. From this example, it is clear that to ensure thermal stability for this class of alloys, it is necessary to control the amount of aluminum, titanium, and niobium as well as the molybdenum and tungsten. The usefulness of Eq. (2) becomes quite clear when considering FIG. 2, where the ductility of the thermally exposed samples is plotted against the value of the left hand side of Eq. (2) for all of the alloys in the study except for alloy 1 where no such test was performed. Only alloys which satisfy the relationship Al+0.56Ti+0.29Nb<2.9 (where the elemental compositions are in wt. %) are plotted in the graph. All testing was performed on samples given an age-hardening heat treatment followed by a thermal exposure of 1600° F. for 1000 hours. In the graph, the tensile ductility (measured as the percent elongation to failure) is plotted as a function of the compositional variable Mo+0.52W (where the elemental compositions are in wt. %). A line is drawn on the figure corresponding to a tensile ductility of 20%. All alloys plotted above this line (symbol: filled circles) were considered to have passed the thermal stability test, while alloys plotted below the line (symbol: x-marks) were considered to have failed. A dashed vertical line is drawn at a value of 9.5 wt. % for the compositional variable, Mo+0.52W. All alloys with a value greater than 9.5 were found to fail the thermal stability test.

TABLE 4

| Alloy | Ductility after 1600° F./1000 hrs./AC (% Elong.) |
|---|---|
| A | 27.8 |
| B | 29.2 |
| C | 28.8 |
| D | 22.2 |
| E | 24.3 |
| F | 29.5 |
| G | 26.3 |
| H | 29.3 |
| I | 34.3 |
| J | 30.8 |
| K | 28.3 |
| L | 30.2 |
| M | 32.1 |
| N | 23.5 |
| O | 32.5 |
| P | 32.8 |
| Q | 29.4 |
| R | 34.5 |

TABLE 4-continued

| Alloy | Ductility after 1600° F./1000 hrs./AC (% Elong.) |
|---|---|
| S | 33.6 |
| T | 29.9 |
| U | 10.4 |
| V | 9.2 |
| W | 27.3 |
| X | 19.0 |
| Y | 33.6 |
| Z | 18.0 |
| R-41 alloy | 2.6 |
| WASPALOY | 12.8 |
| 263 alloy | 40.9 |
| M-252 alloy | 10.1 |
| PK-33 alloy | 26.2 |

The third key property for the target application is creep strength. The creep-rupture strength of the alloys was measured at 1700° F. with a load of 7 ksi. A rupture life of greater than 300 hours was the established goal. The results for the experimental and commercial alloys are shown in Table 5. All of the experimental alloys were found to pass the goal, with the exception of alloys V, Y, and Z. The commercial alloys all passed with the exception of 263 alloy and WASPALOY alloy. Of the total of five alloys which failed the creep-rupture goal, three of them (alloys V and Z, as well as WASPALOY alloy) did not satisfy one or both of Eqs. (1) and (2) and were thermally unstable. Thermal instability can be a negative influence on creep strength. The other two alloys which did not meet the creep strength goal (alloy Y and 263 alloy) both had a relatively low total content of the solid solution strengthening elements molybdenum and tungsten. Additionally, the 263 alloy had a low total content of the gamma-prime forming elements aluminum, titanium, and niobium. To ensure adequate levels of both the solid solution strengthening elements and the gamma-prime forming elements, the Eqs. (1) and (2) were modified respectfully as (where the elemental compositions are in wt. %):

$$2.2<Al+0.56Ti+0.29Nb<2.9 \quad (3)$$

and $$6.5<Mo+0.52W<9.5 \quad (4)$$

Figure 3:
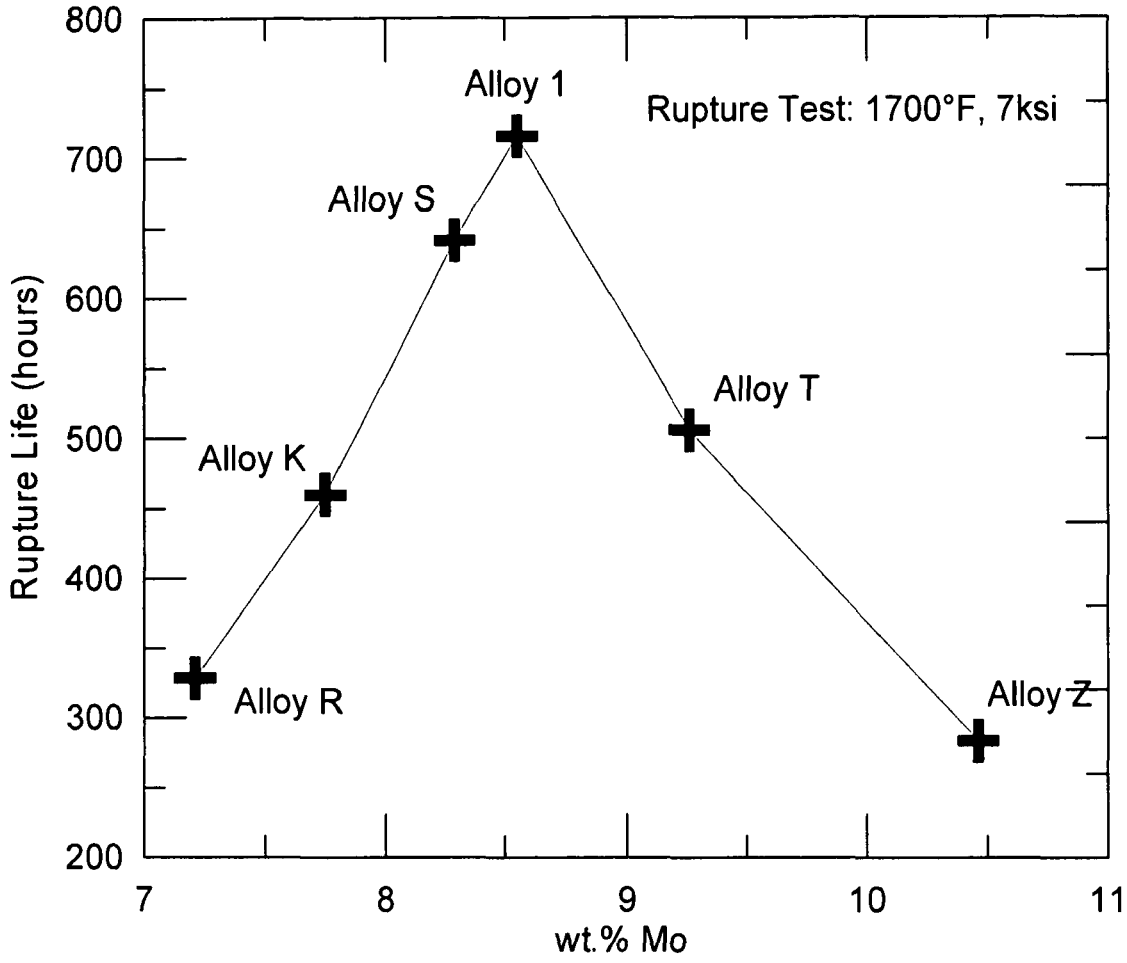
FIG. 3 is a graph of rupture life of several wrought age-hardenable nickel-chromium-cobalt based alloys over a range of molybdenum content.

Higher molybdenum and tungsten levels lead to less thermal stability and lower creep strength. In FIG. 3 rupture life is plotted against molybdenum content for some of the alloy compositions in Table 1. The compositions of the alloys in FIG. 3 have certain similarities such as the Cr content, Co content; a negligible Nb content, and a negligible W content. Therefore, the primary variable in this composition is the Mo content. The graph shows that rupture life is best in alloy 1 containing 8.6% molybdenum and decreases sharply with further increases in Mo level. Alloy T at 9.3% molybdenum has a rupture life of about 200 hours less than alloy 1. Accordingly, molybdenum content should be further limited to not exceed 9.1%. A similar effect could also be expected if the W (that is Mo+0.52W) levels are too high. Therefore, equation (4) should be changed to require:

$$6.5<Mo+0.52W<9.1. \quad (5)$$

Figure 2:
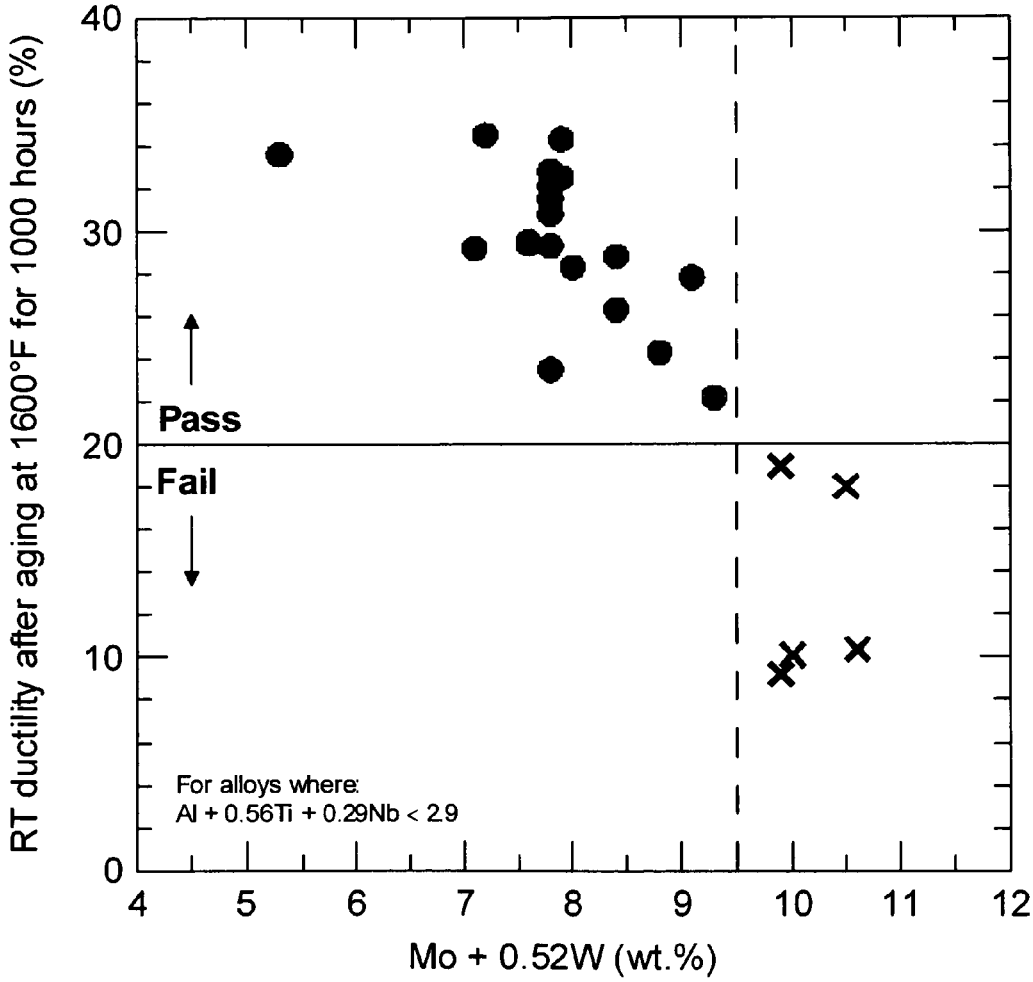
FIG. 2 is a graph of the ductility of several wrought age-hardenable nickel-chromium-cobalt based alloys in a standard tensile test at room temperature.

Of the 32 total experimental and commercial alloys tested in this study, Alloy 1 was not tested for all key properties, Alloys A through T were found to pass all three key property tests, i.e. the CHRT test, the thermal exposure test, and the creep-rupture test. But, Alloy D and T, which contain a Mo+0.52 W level of 9.3%, barely passed the ductility test, whose results are shown in FIG. 2. Furthermore, the high Mo+0.52 W content is associated with a lower rupture life as discussed in the preceding paragraph and does not satisfy Eq. (5). Experimental alloys A through C and E through S had compositions which satisfied both Eqs. (3) and (5). The 11 other alloys which were deemed unacceptable (which included experimental alloys U through Z and all five of the commercial alloys) had compositions which failed to satisfy one or both of Eqs. (3) and (5). From Table 1 it can be seen that the acceptable alloys contained in weight percent 17.5 to 21.3 chromium, 8.3 to 14.2 cobalt, 4.3 to 8.6 molybdenum, up to 7.0 tungsten, 1.29 to 1.63 aluminum, 1.59 to 2.28 titanium, up to 0.79 niobium, 0.034 to 0.097 carbon, 0.002 to 0.007 boron and up to 2.6 iron. For the reasons explained below, alloys containing these elements within the following ranges and meeting Eqs. (3) and (5) should provide the desired properties: 17 to 22 chromium, 8 to 15 cobalt, 4.0 to 9.1 molybdenum, up to 7.0 tungsten, 1.39 to 1.65 aluminum, 1.50 to 2.30 titanium, up to 0.80 niobium, 0.01 to 0.2 carbon, less than 0.02 zirconium, and up to 0.015 boron with the balance being nickel plus impurities. The alloy may also contain tantalum, up to 1.5 wt. %, manganese, up to 1.5 wt. %, silicon, up to 0.5 wt. %, and one or more of magnesium, calcium, hafnium, yttrium, cerium and lanthanum. Each of these seven elements may be present up to 0.05 wt. %. The acceptable alloys had a range of values for Al+0.56 Ti+0.29 Nb of from 2.35 to 2.84 and a range for Mo+0.52 W of from 7.1 to 9.1.

TABLE 5

| Alloy | Rupture Life (hours) |
|---|---|
| 1 | 716 |
| A | 304 |
| B | 560 |
| C | 481 |
| D | 375 |
| E | 346 |
| F | 522 |
| G | 584 |
| H | 764 |
| I | 410 |
| J | 767 |
| K | 560 |
| L | 522 |
| M | 581 |
| N | 401 |
| O | 403 |
| P | 664 |
| Q | 419 |
| R | 328 |
| S | 641 |
| T | 506 |
| U | 384 |
| V | 284 |
| W | 463 |
| X | 339 |
| Y | 271 |
| Z | 283 |
| R-41 alloy | 618 |
| WASPALOY | 243 |
| 263 alloy | 139 |
| M-252 alloy | 392 |
| PK-33 alloy | 412 |

The data from Table 5 shows that alloys meeting the following additional compositional requirements will have rupture lives of 450 hours or better:

$$8.0 \leqq Mo+0.52W \leqq 9.0$$

1.40 to 1.65 aluminum $$Nb \leqq 0.5$$

The example alloys which fall within these limits are C, F, G, S and 1. Otherwise acceptable alloys A, D, E. I, N, O, Q, and R do not meet these requirements and have a rupture life shorter than 450 hours.

Certain factors (economic, contamination, availability, etc.) may require an alloy without tungsten or niobium additions. It was found that alloys which contained significant amounts of neither Nb nor W had significant potential and could be expected to have very high rupture lives when the composition was controlled properly. Plotted against the molybdenum content in FIG. 3 are the rupture life of alloys which met Eq. (3), had no intentional Nb or W addition, and had the following limits on Al and Ti:

$$1.39 \leqq Al \leqq 1.65$$

$$1.65 \leqq Ti \leqq 2.30$$

In this figure the significant compositional variable between the alloys is the molybdenum content. It can be seen that an optimal molybdenum content range exists in which the rupture life is a maximum. On both the lower molybdenum and higher molybdenum sides of this plot the rupture life is seen to be an approximately linear function of the molybdenum content. By linear regression the following relationships are found (where Mo is expressed in wt. %):

$$\text{(low Mo side): Rupture Life (hours)} = 288\ Mo - 1726$$

$$\text{(high Mo side): Rupture Life (hours)} = -186\ Mo + 2234$$

Solving these equations for a desired rupture life of 550 hours or greater leads to the following restriction of the Mo content:

$$7.9 \leqq Mo \leqq 9.1$$

Consideration of GB 1029609 reveals that much of the claimed compositional range does not satisfy Eq. (3) or the preferred Al and Ti ranges taught in the present invention and therefore many alloys within the claimed ranges would not be expected to satisfy all of the three key requirements for gas transition ducts described herein. Therefore, GB 1029609 does not teach how to control alloy composition in such a way as to obtain the desired key properties for a gas turbine transition duct as described herein.

Consideration of JP 01129942 reveals that much of the claimed compositional range does not satisfy Eq. (3) or the preferred Al and Ti ranges taught in the present invention and therefore many alloys within the claimed ranges would not be expected to satisfy all of the three key requirements for gas transition ducts described herein. Furthermore, the required presence of Zr would be expected to lead to increased susceptibility to hot cracking during welding. Therefore, JP 01129942 does not teach how to control alloy composition in such a way as to obtain the desired key properties for a gas turbine transition duct as described herein.

Consideration of JP 06172900 reveals that much of the claimed compositional range does not satisfy Eqs. (3) and/or (5), or the preferred Al, Ti, or Mo ranges taught in the present invention. Therefore, many alloys within the claimed ranges would not be expected to satisfy all of the three key requirements for gas transition ducts described herein. Specifically, example alloy Z as well as the commercial alloy R-41 are within the claimed ranges of JP 06172900, but both fail the thermal stability test. In addition, alloy Z fails the creep test and R-41 alloy fails the strain-age cracking test. Therefore, JP 01129942 does not teach how to control alloy composition in such a way as to obtain the desired key properties for a gas turbine transition duct as described herein.

The presence of chromium (Cr) in alloys used in high temperature environments provides for necessary oxidation and hot corrosion resistance. In general, the higher the Cr content the better the oxidation resistance, however, too much Cr can lead to thermal instability in the alloy. For the alloys of this invention, it was found that the chromium level should be between about 17 to 22 wt. %.

Cobalt (Co) is a common element in many wrought gamma-prime strengthened alloys. Cobalt decreases the solubility of aluminum and titanium in nickel at lower temperatures allowing for a greater gamma-prime content for a given level of aluminum and titanium. It was found that Co levels of about 8 to 15 wt. % are acceptable for the alloys of this invention.

As mentioned previously, aluminum (Al), titanium (Ti), and niobium (Nb) contribute to the creep-strength of the alloys of this invention through the formation of the strengthening gamma-prime phase upon an age-hardening heat treatment. The gamma-prime phase ($Ni_3Al$) can support partial substitution of Al by Ti or Nb to a certain degree. Further increases in the latter two elements relative to Al will eventually promote the formation of $Ni_3Ti$ or $Ni_3Nb$ over the gamma-prime phase. Even in cases where the gamma-prime phase is formed during the initial heat treatment, alloys which contain too much Ti or Nb relative to Al may suffer from a phase transformation from gamma-prime to one of the other phases mentioned above. This will result in degradation of desired properties such as creep strength and retained ductility. To ensure the stability of the gamma-prime phase it is necessary to ensure a sufficiently high Al content relative to Ti and Nb. For the range of total Al, Ti, and Nb content defined by Eq. (3), the preferred minimum Al content is 1.39. The combined total of these elements is limited by Eq. (3) above. In terms of the individual elements, it was found that Al could range from 1.39 to 1.65 wt. %, Ti could range from 1.50 to 2.30 wt. %, and Nb could range from nil to 0.80 wt. %. In alloys were Nb is not intentionally included, an impurity level of up to 0.5% could be expected and tolerated.

As previously stated, molybdenum (Mo) and tungsten (W) contribute to the creep-rupture strength of the alloys of this invention through solid solution strengthening. The combined total of these elements is limited by Eq. (5) above. In terms of the individual elements, and taking equation (5) into consideration, it was found that Mo could range from about 4.0 to 9.1 wt. %, while W could range from nil to about 7.0 wt. %. In alloys where W is not intentionally included, an impurity level of up to 0.5% could be expected and tolerated.

Carbon (C) is a necessary component and contributes to creep-strength of the alloys of this invention through formation of carbides. Carbides are also necessary for proper grain size control. Carbon should be present in the amount of about 0.01 to 0.2 wt. %.

Iron (Fe) is not required, but typically will be present. The presence of Fe allows economic use of revert materials, most of which contain residual amounts of Fe. An acceptable, Fe-free alloy might be possible using new furnace linings and high purity charge materials. The presented data indicate that levels up to at least about 3 wt. % are acceptable.

Boron (B) is normally added to wrought gamma-prime strengthened alloys in small amounts to improve elevated temperature ductility. Too much boron may lead to weldability problems. The preferred range is up to about 0.015 wt. %.

Tantalum (Ta) is a gamma-prime forming element in this class of alloys. It is expected that tantalum could be partially substituted for aluminum, titanium, or niobium at levels up to about 1.5 wt. %.

Manganese (Mn) is often added to nickel based alloys to help control problems arising from the presence of sulfur impurities. It is expected that Mn could be added to alloys of this invention to levels of at least 1.5 wt. %.

Silicon (Si) can be present as an impurity and is sometimes intentionally added for increased environmental resistance. It is expected that Si could be added to alloys of this invention to levels of at least 0.5 wt. %.

Copper (Cu) can be present as an impurity originating either from the use of revert materials or during the melting and processing of the alloy itself. It is expected that Cu could be present in amounts up to at least 0.5 wt. %.

Zirconium (Zr) can cause hot cracking problems during welding. To avoid this problem zirconium levels should be as low as possible and should not exceed 0.02 wt. %.

The use of magnesium (Mg) and calcium (Ca) is often employed during primary melting of nickel base alloys. It is expected that levels of these elements up to about 0.05 wt. % could be present in alloys of this invention.

Often, small amounts of certain elements are added to nickel based alloys to provide increased environmental resistance. These elements include, but are not necessarily limited to lanthanum (La), cerium (Ce), yttrium (Y), and hafnium (Hf). It is expected that amounts of each of these elements up to about 0.05 wt. % could be present in alloys of this invention.

Even though the samples tested were limited to wrought sheet, the alloys should exhibit comparable properties in other wrought forms (such as plates, bars, tubes, pipes, forgings, and wires) and in cast, spray-formed, or powder metallurgy forms, namely, powder, compacted powder and sintered compacted powder. Consequently, the present invention encompasses all forms of the alloy composition.

The combined properties of good thermal stability, resistance to strain age cracking and good creep rupture strength exhibited by this alloy make it particularly useful for fabrication into gas turbine engine components and particularly useful for transition ducts in these engines. Such components and engines containing these components can be operated at higher temperatures without failure and should have a longer service life than those components and engines currently available.

Although I have disclosed certain preferred embodiments of the alloy, it should be distinctly understood that the present invention is not limited thereto, but may be variously embodied within the scope of the following claims.

I claim:

1. A nickel-chromium-cobalt based alloy having a composition comprised in weight percent of:

| | |
|---|---|
| 17 to 22 | chromium |
| 8 to 15 | cobalt |
| 4.0 to 9.1 | molybdenum |
| up to 7.0 | tungsten |
| 1.39 to 1.65 | aluminum |
| 1.50 to 2.30 | titanium |
| up to 0.80 | niobium |
| 0.01 to 0.2 | carbon |
| up to 0.015 | boron |
| up to 1.5 | tantalum |
| less than 0.02 | zirconium |

with a balance of nickel and impurities, the alloy further satisfying the following compositional relationships defined with elemental quantities being in terms of weight percent:

$$2.2<Al+0.56Ti+0.29Nb<2.9$$

$$6.5<Mo+0.52W\leqq 9.1.$$

2. The nickel-chromium-cobalt based alloy of claim 1, also containing iron up to 3 weight percent.

3. The nickel-chromium-cobalt based alloy of claim 1, also containing in weight percent at least one of tantalum, up to 1.5%, manganese, up to 1.5%, silicon, up to 0.5%, and copper, up to 0.5%.

4. The nickel-chromium-cobalt based alloy of claim 1, also containing at least one element selected from the group consisting of magnesium, calcium, hafnium, yttrium, cerium, and lanthanum, wherein each said element present comprises up to 0.05 weight percent of the alloy.

5. The nickel-chromium-cobalt based alloy of claim 1 wherein the alloy is in a form selected from the group consisting of wrought form, cast form, spray-formed and powder metallurgy form.

6. The nickel-chromium-cobalt based alloy of claim 5, wherein the wrought form is selected from the group consisting of sheets, plates, bars, wires, tubes, pipes, and forgings.

7. The nickel-chromium-cobalt based alloy of claim 1 wherein the alloy is formed as a component for a gas turbine engine.

8. The nickel-chromium-cobalt alloy of claim 1 wherein the alloy contains in weight percent 1.40 to 1.65 aluminum, and $$8.0\leqq Mo+0.52W\leqq 9.0$$

$$Nb\leqq 0.5.$$

9. A nickel-chromium-cobalt based alloy, suitable for use in gas turbine transition ducts, having a composition comprised in weight percent of:

| | |
|---|---|
| 17.5 to 21.3 | chromium |
| 8.3 to 14.2 | cobalt |
| 4.3 to 9.1 | molybdenum |
| up to 7.0 | tungsten |
| 1.39 to 1.65 | aluminum |
| 1.59 to 2.28 | titanium |
| up to 0.79 | niobium |
| 0.034 to 0.097 | carbon |
| 0.002 to 0.007 | boron |
| up to 2.6 | iron |
| up to 1.5 | tantalum |
| less than 0.02 | zirconium |

with a balance of nickel and impurities, the alloy further satisfying the following compositional relationships defined with elemental quantities being in terms of weight percent:

$$2.35<Al+0.56Ti+0.29Nb<2.84$$

$$7.1<Mo+0.52W\leqq 9.1.$$

10. The nickel-chromium-cobalt based alloy of claim 9, also containing in weight percent at least one of tantalum, up to 1.5%, manganese, up to 1.5%, silicon, up to 0.5%, and copper, up to 0.5%.

11. The nickel-chromium-cobalt based alloy of claim 9, also containing up to at least one element selected from the group consisting of magnesium, calcium, hafnium, yttrium, cerium, and lanthanum, wherein each said element present comprises up to 0.05 weight percent of the alloy.

12. The nickel-chromium-cobalt based alloy of claim 9 wherein the alloy is in a form selected from the group consisting of wrought form, cast form, spray-formed and powder metallurgy form.

13. The nickel-chromium-cobalt based alloy of claim 12, wherein the wrought form is selected from the group consisting of sheets, plates, bars, wires, tubes, pipes, and forgings.

14. The nickel-chromium-cobalt based alloy of claim 9 wherein the alloy is formed as a component for a gas turbine engine.

15. The nickel-chromium-cobalt alloy of claim 9 wherein the alloy contains in weight percent 1.40 to 1.65 aluminum, and $$8.0 \leqq Mo+0.52W \leqq 9.0$$

$$Nb \leqq 0.5.$$

16. An improved gas turbine engine having a plurality of metal components wherein the improvement comprises at least one of the metal components in weight percent consisting essentially of:

| | |
|---|---|
| 17 to 22 | chromium |
| 8 to 15 | cobalt |
| 4.0 to 9.1 | molybdenum |
| up to 7.0 | tungsten |
| 1.39 to 1.65 | aluminum |
| 1.50 to 2.30 | titanium |
| up to 0.80 | niobium |
| 0.01 to 0.2 | carbon |
| up to 0.015 | boron |
| up to 1.5 | tantalum |
| less than 0.02 | zirconium |

with a balance of nickel and impurities, the alloy further satisfying the following compositional relationships defined with elemental quantities being in terms of weight percent:

$$2.2 < Al+0.56Ti+0.29Nb < 2.9$$

$$6.5 < Mo+0.52W \leqq 9.1.$$

17. The improved gas turbine engine of claim 16 wherein the at least one of the metal components is a transition duct.

18. The improved gas turbine engine of claim 16 where the at least one of the metal components in weight percent consists essentially of:

| | |
|---|---|
| 17.5 to 21.3 | chromium |
| 8.3 to 14.2 | cobalt |
| 4.3 to 9.1 | molybdenum |
| up to 7.0 | tungsten |
| 1.39 to 1.65 | aluminum |
| 1.59 to 2.28 | titanium |
| up to 0.79 | niobium |
| 0.034 to 0.097 | carbon |
| 0.002 to 0.007 | boron |
| up to 2.6 | iron |
| up to 1.5 | tantalum |
| less than 0.02 | zirconium |

with a balance of nickel and impurities, the alloy further satisfying the following compositional relationships defined with elemental quantities being in terms of weight percent:

$$2.35 < Al+0.56Ti+0.29Nb < 2.84$$

$$7.1 < Mo+0.52W \leqq 9.1.$$

19. The improved gas turbine engine of claim 16 wherein the alloy consisting essentially of in weight percent 1.40 to 1.65 aluminum and $$8.0 \leqq Mo+0.52W \leqq 9.0$$

$$2.45 \leqq Al+0.56Ti+0.29Nb \leqq 2.9.$$

20. A nickel-chromium-cobalt based alloy having a composition comprised in weight percent of:

| | |
|---|---|
| 17 to 22 | chromium |
| 8 to 15 | cobalt |
| 7.9 to 9.1 | molybdenum |
| up to 0.5 | tungsten |
| 1.39 to 1.65 | aluminum |
| 1.50 to 2.30 | titanium |
| up to 0/5 | niobium |
| 0.01 to 0.2 | carbon |
| up to 0.015 | boron |
| up to 1.5 | tantalum |
| less than 0.02 | zirconium |

with the balance of nickel and impurities, the alloy further satisfying the following compositional relationships defined with elemental quantities being in terms of weight percent:

$$2.2 < Al+0.56Ti+0.29Nb < 2.9$$

$$8.0 < Mo+0.52W \leqq 9.0.$$

21. The nickel-chromium-cobalt based alloy of claim 20, also comprising iron up to 3 weight percent.

22. The nickel-chromium-cobalt based alloy of claim 20, also containing in weight percent at least one of tantalum, up to 1.5%, manganese, up to 1.5%, silicon, up to 0.5%, and copper, up to 0.5%.

23. The nickel-chromium-cobalt based alloy of claim 20, also containing at least one element selected from the group consisting of magnesium, calcium, hafnium, yttrium, cerium, and lanthanum, wherein each said element present comprises up to 0.05 weight percent of the alloy.

24. The nickel-chromium-cobalt based alloy of claim 20 wherein the alloy is in a form selected from the group consisting of wrought form, cast form, spray-formed and powder metallurgy form.

25. The nickel-chromium-cobalt based alloy of claim 24, wherein the wrought form is selected from the group consisting of sheets, plates, bars, wires, tubes, pipes, and forgings.

26. A nickel-chromium-cobalt based alloys, suitable for use in gas turbine transition ducts, having a composition comprised in weight percent of:

| | |
|---|---|
| 17.5 to 21.3 | chromium |
| 8.3 to 14.2 | cobalt |
| 7.9 to 9.1 | molybdenum |
| less than 0.1 | tungsten |
| 1.39 to 1.63 | aluminum |
| 1.59 to 2.28 | titanium |
| up to 0.5 | niobium |
| 0.034 to 0.097 | carbon |
| 0.002 to 0.007 | boron |
| up to 2.6 | iron |
| up to 1.5 | tantalum |

with a balance of nickel and impurities, the alloy further satisfying the following compositional relationships defined with elemental quantities being in terms of weight percent:

$$2.35 < Al+0.56Ti+0.29Nb < 2.84$$

$$8.0 < Mo+0.25W \leqq 9.0.$$

27. The nickel-chromium-cobalt based alloy of claim 26 also comprising zirconium present in an amount less than 0.02 weight percent.

28. The nickel-chromium-cobalt based alloy of claim 26, also containing in weight percent at least one of tantalum, up to 1.5%, manganese, up to 1.5%, silicon, up to 0.5%, and copper, up to 0.5%.

29. The nickel-chromium-cobalt based alloy of claim 26, also containing at least one element selected from the group consisting of magnesium, calcium, hafnium, yttrium, cerium, and lanthanum, wherein each said element present comprises up to 0.05 weight percent of the alloy.

30. The nickel-chromium-cobalt based alloy of claim 26 wherein the alloy is in a form selected from the group consisting of wrought form, cast form, spray-formed and powder metallurgy form.

31. The nickel-chromium-cobalt based alloy of claim 30, wherein the wrought form is selected from the group consisting of sheets, plates, bars, wires, tubes, pipes, and forgings.

32. The nickel-chromium-cobalt based alloy of claim 26 wherein the alloy contains less than 0.05 weight percent niobium.

33. The nickel-chromium-cobalt based alloy of claim 32 also comprising zirconium present in an amount less than 0.02 weight percent.

* * * * *